US006884468B1

(12) United States Patent
Abundis et al.

(10) Patent No.: US 6,884,468 B1
(45) Date of Patent: Apr. 26, 2005

(54) METHOD OF MAKING A PAPER COATING USING A BLEND OF A VINYL AROMATIC-ACRYLIC POLYMER DISPERSION WITH A VINYL AROMATIC-DIENE POLYMER DISPERSION

(75) Inventors: David L. Abundis, Charlotte, NC (US); Peter C. Hayes, Charlotte, NC (US); Ronald E. Hostetler, Rock Hill, SC (US)

(73) Assignee: BASF AG, Rheinland-Praiz (DE)

( * ) Notice: Subject to any disclaimer, the term of this patent is extended or adjusted under 35 U.S.C. 154(b) by 0 days.

(21) Appl. No.: 10/694,576

(22) Filed: Oct. 27, 2003

(51) Int. Cl.[7] ..... B05D 3/02

(52) U.S. Cl. ..... 427/391; 427/395

(58) Field of Search ..... 427/391, 395

(56) References Cited

U.S. PATENT DOCUMENTS

| | | | |
|---|---|---|---|
| 3,821,267 | A | 6/1974 | Rice |
| 4,064,304 | A | 12/1977 | Fujita et al. |
| 4,092,457 | A | 5/1978 | Fujita et al. |

(Continued)

FOREIGN PATENT DOCUMENTS

| | | | |
|---|---|---|---|
| CA | 984988 | | 3/1976 |
| EP | 600801 | | 3/1997 |
| EP | 952483 | | 10/1999 |
| EP | 1010807 | | 6/2000 |
| GB | 1174274 | | 12/1969 |
| JP | 57191392 | | 11/1982 |
| JP | 61055289 | | 3/1986 |
| JP | 63275791 | | 11/1988 |
| JP | 01229894 | | 9/1989 |
| JP | 02169800 | | 6/1990 |
| JP | 05195493 | | 8/1993 |
| JP | 06123100 | | 5/1994 |
| JP | 06157821 | | 6/1994 |
| JP | 09005931 | | 1/1997 |
| JP | 11-012989 | * | 1/1999 |
| JP | 2000095995 | | 4/2000 |
| JP | 2001040314 | | 2/2001 |
| WO | WO9832920 | | 7/1998 |
| WO | WO0104416 | | 1/2001 |
| WO | WO0107529 | | 2/2001 |
| WO | WO02083785 | | 10/2002 |

OTHER PUBLICATIONS

Hayes, Coating Materials: Pigment, Binders & Additives Short Course, Mar. 2002, pp 115–123.*

English Language Abstract from EPO for EP600801, Jun. 8, 1994.

Derwent Accession No. 1986–115663, English language abstract for JP61055289, Mar. 19, 1986.

Derwent Accession No. 1988–365296, English language abstract for JP63275791, Nov. 14, 1988.

Derwent Accession No. 1989–312514, English language abstract for JP01229894, Sep. 13, 1989.

Derwent Accession No. 1990–243088, English language abstract for JP02169800, Jun. 29, 1990.

*Primary Examiner*—Erma Cameron

(57) ABSTRACT

A method comprising: (I) providing a composition; (II) applying the composition to a paper substrate; and (III) forming a paper coating on the paper substrate; wherein the composition comprises a blend of polymers, wherein the blend of polymers comprises a vinyl aromatic-acrylic polymer and a vinyl aromatic-diene polymer, wherein the vinyl aromatic-acrylic polymer comprises a reaction product of vinyl aromatic and an alkyl (meth)acrylate, and the vinyl aromatic-diene polymer comprises a reaction product of vinyl aromatic and a conjugated diene, wherein, based on a solids weight of all polymers in the blend of polymers, the vinyl aromatic-acrylic polymer is present in the blend of polymers in an amount from 50% to about 95% and the vinyl aromatic-diene polymer is present in an amount from about 5% to 50%.

13 Claims, 2 Drawing Sheets

U.S. PATENT DOCUMENTS

| | | | | | |
|---|---|---|---|---|---|
| 4,209,562 | A | | 6/1980 | Suwala et al. | |
| 4,245,689 | A | | 1/1981 | Grard et al. | |
| 4,503,184 | A | | 3/1985 | Marongiu | |
| 4,567,099 | A | | 1/1986 | Van Gilder et al. | |
| 4,686,260 | A | | 8/1987 | Lindemann et al. | |
| 5,268,419 | A | | 12/1993 | Stack et al. | |
| 5,283,129 | A | | 2/1994 | Renk et al. | |
| 5,308,890 | A | | 5/1994 | Snyder | |
| 5,494,963 | A | * | 2/1996 | Hayes | 524/813 |
| 5,500,191 | A | | 3/1996 | DeMatte | |
| 5,523,345 | A | * | 6/1996 | Diehl et al. | 524/555 |
| 5,543,455 | A | | 8/1996 | Shah | |
| 5,563,201 | A | | 10/1996 | Joanicot et al. | |
| 5,656,685 | A | | 8/1997 | Satgurunathan et al. | |
| 5,726,259 | A | * | 3/1998 | Hayes et al. | 526/80 |
| 5,770,303 | A | | 6/1998 | Weinert et al. | |
| 5,824,748 | A | | 10/1998 | Kesti et al. | |
| 5,846,381 | A | | 12/1998 | Wirth et al. | |
| 5,931,354 | A | | 8/1999 | Braud et al. | |
| 5,962,579 | A | | 10/1999 | Schulz et al. | |
| 6,171,702 | B1 | | 1/2001 | Malhotra et al. | |
| 6,194,064 | B1 | | 2/2001 | Keely et al. | |
| 6,451,899 | B1 | | 9/2002 | Zhao et al. | |
| 6,451,900 | B1 | | 9/2002 | Kuehn et al. | |
| 2001/0023738 | A1 | | 9/2001 | Vaidya | |
| 2002/0061981 | A1 | | 5/2002 | Donald et al. | |
| 2002/0061982 | A1 | | 5/2002 | Donald et al. | |
| 2002/0146552 | A1 | | 10/2002 | Murnick et al. | |
| 2002/0169250 | A1 | | 11/2002 | Ishihara | |
| 2002/0185239 | A1 | | 12/2002 | Kimpimaki et al. | |
| 2003/0195297 | A1 | | 10/2003 | Burghart et al. | |

OTHER PUBLICATIONS

Derwent Accession No. 1993–278838, English language abstract for JP05195493, Aug. 3, 1993.

Derwent Accession No. 1994–186730, English language abstract for JP06123100, May 6, 1994.

Derwent Accession No. 1994–222109, English language abstract for JP06157821, Jun. 7, 1994.

Derwent Accession No. 1997–122887, English language abstract for JP09005931, Jan. 10, 1997.

Derwent Accession No. 2000–313103, English language abstract for JP2000095995, Apr. 4, 2000.

Derwent Accession No. 2001–276215, English language abstract for JP2001040314, Feb. 13, 2001.

Derwent Accession No. 1995–262348, English language abstract for RU2027816, Jan. 27, 1995.

Polymer Dispersions and Their Industrial Applications, Edited by Dieter Urban et al., Chapter 4: Applications in the Paper Industry, by Jürgen Schmidt–Thümmes et al., pp. 75–101, Wiley–VCH, 2002.

* cited by examiner

METHOD OF MAKING A PAPER COATING USING A BLEND OF A VINYL AROMATIC-ACRYLIC POLYMER DISPERSION WITH A VINYL AROMATIC-DIENE POLYMER DISPERSION

BACKGROUND OF THE INVENTION

Paper coatings are applied to paper substrates, such as paper and paper board, as a finish for the paper. Paper coatings improve the printability of the paper substrate in many printing operations. Further information about paper coatings can be found in Polymer Dispersions and Their Industrial Applications, Edited by Dieter Urban et al., Chapter 4: Applications in the Paper Industry, by Jürgen Schmidt-Thümmes et al., pp. 75–101, Wiley-VCH, 2002, which is incorporated herein by reference.

Not all paper coating compositions can improve multiple paper coating properties simultaneously.

It would be desirable to use a paper coating composition that can improve selected properties for a paper coating.

SUMMARY OF THE INVENTION

A method comprising: (I) providing a composition, (II) applying the composition to a paper substrate; and (III) forming a paper coating on the paper substrate; wherein the composition comprises a blend of polymers, wherein the blend of polymers comprises a vinyl aromatic-acrylic polymer and a vinyl aromatic-diene polymer, wherein the vinyl aromatic-acrylic polymer comprises a reaction product of vinyl aromatic and an alkyl (meth)acrylate, and the vinyl aromatic-diene polymer comprises a reaction product of vinyl aromatic and a conjugated diene, wherein, based on a solids weight of all polymers in the blend of polymers, the vinyl aromatic-acrylic polymer is present in the blend of polymers in an amount from 50% to about 95% and the vinyl aromatic-diene polymer is present in an amount from about. 5% to 50%, wherein the vinyl aromatic-acrylic polymer is present in the blend of polymers in an amount from 50% to 65%, the amount of vinyl aromatic in the vinyl aromatic-acrylic polymer is from about 5% to less than 20% by weight.

DETAILED DESCRIPTION

Figure 1:
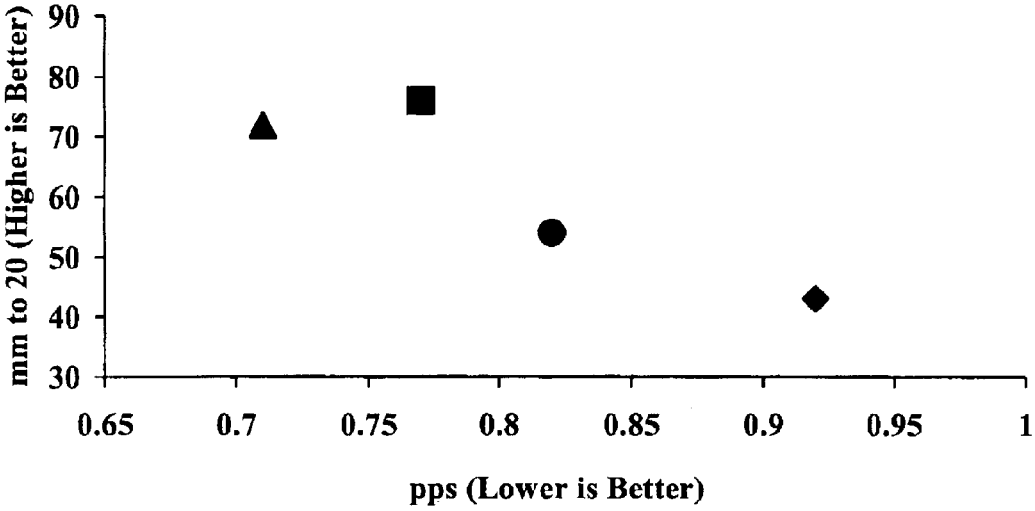
FIG. 1 is a graph of Helio Variable Halftone vs. Parker Print Surf (pps) for the samples from Example 1.

As used throughout, ranges are used as a shorthand for describing each and every value that is within the range. Any value within the range can be selected as the terminus of the range.

The present invention relates to a method comprising: (I) providing a composition; (II) applying the composition to a paper substrate; and (III) forming a paper coating on the paper substrate; wherein the composition comprises a blend of polymers, wherein the blend of polymers comprises a vinyl aromatic-acrylic polymer and a vinyl aromatic-diene polymer, wherein the vinyl aromatic-acrylic polymer comprises a reaction product of vinyl aromatic and an alkyl (meth)acrylate, and the vinyl aromatic-diene polymer comprises a reaction product of vinyl aromatic and a conjugated diene, wherein, based on a solids weight of all polymers in the blend of polymers, the vinyl aromatic-acrylic polymer is present in the blend of polymers in an amount from 50% to about 95% and the vinyl aromatic-diene polymer is present in an amount from about 5% to 50%. Preferably, the vinyl aromatic-acrylic polymer is present in an amount from about 50% to about 90%, and the vinyl aromatic-diene polymer is present in an amount from about 100% to about 50%.

In a preferred embodiment, based on the total weight of the vinyl aromatic-diene polymer, the vinyl aromatic is present in an amount from greater than 0 to about 90% (preferably from about 20% to about 80%), and the conjugated diene is present in an amount from about 10 to less than 100% (preferably from about 20% to about 80%). Also, based on the total weight of the vinyl aromatic-acrylic polymer, the vinyl aromatic is present in an amount from about 5% to about 60%, and the alkyl (meth)acrylate is present in an amount from about 40% to about 95%. When the vinyl aromatic-acrylic polymer is present in the blend of polymers in an amount from 50% to 65%, the amount of vinyl aromatic in the vinyl aromatic-acrylic polymer is from about 5% to less than 20% by weight.

Examples of the vinyl aromatic-acrylic polymer latex and the vinyl aromatic-diene polymer latex can be found in U.S. Pat. No. 5,846,381, which is incorporated herein by reference. Also, examples of further monomers that can be used to form these polymers, examples of other materials used in the reaction to make the polymers, and methods of making the polymers can be found in U. S. Ser. No. 10/023,400, filed on 13 Dec. 2001, which is incorporated herein by reference.

In a preferred embodiment, the styrene-vinyl aromatic polymer latex comprises a reaction product of (a1) an alkyl (meth)acrylate in an amount from 40 to 95, particularly preferably from 45 to 85, % by weight based on the total weight of the vinyl aromatic-acrylic polymer, (a2) a vinyl aromatic monomer in an amount from 5 to 60, preferably from 5 to 55% by weight based on the total weight of the vinyl aromatic-acrylic polymer, and (a3) optionally, a further olefinically unsaturated monomer in an amount from 0 to 30, preferably from 1 to 10, % by weight based on the total weight of the vinyl aromatic-acrylic polymer.

The alkyl(meth)acrylates are esters of (meth)acrylic acid with C1–C12-alkanols or mixtures of such esters. Preferably, the alkanols are C4–C12 alkanols. Preferred alkanols include, but are not limited to, butanol, 2-ethylhexanol, isobutanol, tert-butanol, n-pentanol isoamyl alcohol, n-hexanol, cyclohexanol, octanol, and lauryl alcohol.

Examples of vinyl aromatics include, but are not limited to, a vinyl aromatic monomer of up to. 20 carbon atoms, styrene, α-methyl styrene, p-methylstyrene, o-chlorostyrene, chloromethyl styrene, α-phenyl styrene, styrene sulfonic acid, salts of styrene sulfonic acid, para-acetoxystyrene, divinylbenzene, diallyl phthalate, vinyl toluene, and vinyl naphthalene.

Examples of the optional further monomer (a3) are monomers capable of free radical polymerization, such as one or more ethylenically unsaturated carboxylic acids and/or the amides and/or anhydrides thereof, for example acrylic acid, acrylamide, methacrylic acid, methacrylamide, itaconic acid, maleic acid or fumaric acid, vinylsulfonic acid, vinylphosphonic acid, acrylamidopropanesulfonic acid, and the water-soluble salts thereof, olefins, such as ethylene, vinyl and vinylidene halides, such as vinyl and vinylidene chloride, esters of vinyl alcohols and monocarboxylic acids of 1 to 18 carbon atoms, such as vinyl acetate, vinyl propionate, vinyl n-butyrate, vinyl laurate and vinyl stearate, and esters of α,β-monoethylenically unsaturated dicarboxylic acids, such as maleic acid, fumaric acid and itaconic acid, with alkanols of in general 1 to 12, preferably 1 to 9, in particular 1 to 4, carbon atoms, such as dimethyl maleate or n-butyl maleate. Other examples are basic monomers, such as (a)

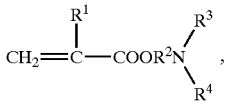

(b)

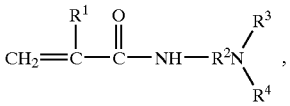

(c)

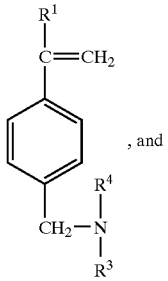

, and (d)

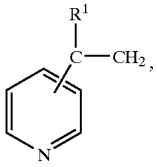

wherein R1 is H or CH3, R2 is alkylene of 1 to 4 carbon atoms, and R3 and R4 are each H or alkyl of 1 to 4 carbon atoms, and other monomers which contain basic centers, are capable of free radical polymerization and may also be in N-protonated or N-alkylated form, for example diallyldimethylammonium chloride. The amount of unsaturated acids is preferably less than 4% by weight.

When the ethylenically unsaturated carboxylic acids are included, the amount of the acid is preferably from about 1 to about 12 percent by weight.

Crosslinking monomers may also be present in polymer A) in amounts of from 0 to 10% by weight, as monomers which contain a further crosslinking functional group in addition to the group capable of free radical polymerization. Examples of such monomers are conjugated dienes listed below, and monomers which are capable of free radical polymerization and have at least one epoxy, hydroxyl, N-alkylol, N-alkoxy, carbonyl, or amidine group or at least two nonconjugated ethylenically unsaturated double bonds. A combination of such compounds is possible. Examples of epoxy-containing monomers are glycidyl acrylate, glycidyl methacrylate, and vinyl glycidyl ether.

Examples of N-alkylol compounds include, but are not limited to, the N-alkylolamides of ethylenically unsaturated carboxylic acids where the alkyl radical is of 1 to 4 carbon atoms, such as N-methylolacrylamide, N-ethanolacrylamide, N-propanolacrylamide, N-methylolmethacrylamide, N-ethanolmethacrylamide, N-methylolmaleimide, N-methylolmaleamide, and N-methylol-p-vinylbenzamide.

Examples of the N-alkoxymethylacrylamides and N-alkoxymethylmethacrylamides include, but are not limited to, compounds where the alkoxy radical is of 1 to 8 carbon atoms, such as N-(methoxymethyl)acrylamide, N-(butoxymethyl)acrylamide, N-(methoxymethyl) methacrylamide, and N-(butoxymethyl)methacrylamide, and methylolallyl carbamates whose methylol groups may be etherified with C1–C8-alkyl. Preferred carbonyl-containing monomers include, but are not limited to, acrolein, diacetoneacrylamide, formylstyrene, vinyl alkyl ketones, (meth)acryloyloxyalkylpropanals according to U.S. Pat. No. 4,250,070, diacetone acrylate, acetonyl acrylate, diacetone methacrylate, 2-hydroxypropyl acrylate acetylacetate, and 1,4-butanediol acrylate acetylacetate.

Examples of an aziridinyl-containing monomer include, but are not limited to, 2-(1-Aziridinyl)ethyl methacrylate.

Examples of crosslinking components having at least two acrylate, methacrylate, alkyl or vinyl groups or corresponding combinations include, but are not limited to, alkylene glycol di(meth)acrylates, such as ethylene glycol diacrylate, 1,3-butylene glycol diacrylate, propylene glycol diacrylate and triethylene glycol dimethacrylate, 1,3-glyceryl dimethacrylate, 1,1,1-trimethylgl propane dimethacrylate, 1,1,1-trimethylolethane diacrylate, pentaerythrityl trimethacrylate, sorbitan pentamethacrylate, methylenebisacrylamide, methylenebismethacrylamide, divinylbenzene, vinyl methacrylate, vinyl crotonate, vinyl acrylate divinyl adipate, diallyl phthalate, allyl methacrylate, allyl acrylate, diallyl malate, diallyl itaconate, diallyl malonate, diallyl carbonate, triallyl citrate, divinyl ether, ethylene glycol divinyl ether, and cyclopentadienyl acrylate and methacrylate.

Further suitable monomers are those having SiR5R6R7 groups, in which R5, R6, and R7 independently of one another are each C1–C4-alkyl or alkoxy, such as methyl, ethyl, methoxy or ethoxy, for example vinyl trialkoxysilanes, acryloyloxysilanes, such as γ-methacryloyloxypropyltrimethoxysilane, and methacryloyloxyethyltrimethylsilane.

In addition to the use of such crosslinking monomers, the internal strength of the polymer films can in certain circumstances be increased by adding metal salts, for example Ca, Mg or Zn salts, after polymerization is complete, provided that the films contain groups capable of bonding with these salts, for example carboxyl groups; it is also possible to add hydrazine derivatives, aminooxyalkanes, and condensates based on formaldehyde, melamine, phenol and/or urea after polymerization is complete.

The vinyl aromatic-acrylic polymer can contain acrylonitrile or methacrylonitrile in amounts of less than 20, more preferably less than 5, and more preferably less than 2, % by weight of the polymer in the vinyl aromatic-acrylic polymer latex.

In one embodiment, the vinyl aromatic-acrylic polymer latex can be prepared in the presence of a molecular weight regulator, for example tertdodecyl mercaptan, carbon tetrachloride, carbon tetrabromide, trichlorobromomethane, butyl mercaptan, allyl alcohol, polytetrahydrofuranbisthiol, mercaptoethanol, acetylacetone, thioglycolic acid, or thioglycolates. Such substances are preferably added to the reaction mixture as a mixture with the monomers to be polymerized.

The vinyl aromatic-acrylic polymer generally has a number average particle sizes of from 50 to 1000 nm, preferably from 80 to 500 nm, more preferably from 100 to 300 nm. Bimodal or polymodal particle size distributions may also be used.

Preferred vinyl aromatic-acrylic polymers are a n-butyl acrylate-styrene polymer latex and a n-butyl acrylate-styrene-acrylonitrile polymer latex. Examples of preferred vinyl aromatic-acrylic polymers are available from BASF Corporation under the following product names sold under the ACRONAL® trademark: NX4787, S504, PR8466, 866 and S728.

In a preferred embodiment, the vinyl aromatic-diene polymer latexes comprises a reaction product of (b1) conjugated diene monomer in an amount from 10 to less than 100, preferably from 20 to 80, more preferably from 20 to 65, % by weight based on the total weight of the vinyl aromatic-diene polymer (b2) vinyl aromatic monomer in an amount from greater than 0 to 90, preferably from 20 to 80, more preferably from 30 to 80, % by weight based on the total weight of the vinyl aromatic-diene polymer, and (b3) optionally, a further olefinically unsaturated monomer in an amount from 0 to 20, by weight based on the total weight of the vinyl aromatic-diene polymer.

Examples of the vinyl aromatic are given above. Examples of the further olefinically unsaturated monomer are given above and include ethylenically unsaturated carboxylic acids, acrylonitrile, methacrylonitrile, and alkyl (meth)acrylates. When included, the ethylenically unsaturated carboxylic acids are present in an amount from about 1 to about 15% by weight, and the (meth)acrylonitrile is present in an amount from about 2 to about 12% by weight.

Examples of the conjugated diene include, but are not limited to, butadiene, isoprene, and chloroprene.

Molecular weight regulators in amounts of from 0 to 5% by weight, based on the amount of monomers used, may be employed for the preparation of the vinyl aromatic-diene polymer. Examples of molecular weight regulators are given above.

Preferred vinyl aromatic-diene polymer latexes are a styrene-butadiene polymer latex, a styrene-butadiene-acrylonitrile polymer latex, and a carboxylated styrene-butadiene polymer latex. By carboxylated it is meant that at least one ethylenically unsaturated carboxylic acid is reacted into the reaction product. Examples of preferred vinyl aromatic-diene polymers are available from BASF Corporation under the following product names sold under the STYRONAL™ trademark: ND430, NX4489X, ND656, NX4681, ND811, NX4222X, NX4515X, BN4606X, BN4204, and NX4690X.

The polymers in the latexes preferably have a calculated glass transition temperatures Tg (according to the Fox Equation) of from −50 to 40° C., more preferably from −40 to 30° C., particularly preferably from −30 to 30° C.

The minimum film forming temperature is usually of the same magnitude as the Tg of the polymer latexes, but may occasionally be substantially lower, possibly because emulsifiers or water are used as plasticizers.

The polymeric components of the vinyl aromatic-acrylic polymer and vinyl aromatic-diene polymer can be prepared in a conventional manner by solution or emulsion polymerization using conventional free radical polymerization initiators.

Suitable free radical polymerization initiators are all those which are capable of initiating a free radical aqueous emulsion polymerization. Initiators that can be used in a reaction to prepare the polymers include any oxidizer. Suitable oxidizers include, but are not limited to persulfates, ammonium persulfate, sodium persulfate, potassium persulfate, peroxides, benzoyl peroxide, t-butyl hydroperoxide, hydrogen peroxide, cumene hydroperoxide, cumic hydroperoxide, y-butyl perpivalate, tert-butyl per-2-ethylhexanoate, 2,5-dimethyl-2,5-di-(tert-butylperoxy)-hexane, azo compounds, azobisisobutyronitrile, and 2,2'-azobis(2-amidinopropane) dihydrochloride. Additionally, reducing agents can be used in combination with the oxidizers.

Reducing agents that can be used include, but are not limited to, sodium formaldehyde sulfoxylate, erythorbic acid, bisulfites, sodium metabisulfite, sodium bisulfite, adducts of a 3 to 8 carbon ketone with the bisulfite ion, adducts of a 3 to 8 carbon ketone with sulfurous acid, reducing sugars, ascorbic acid, sulfinic acids, hydroxymethane-sulfinic acid, alkane sulfinic acids, isopropane sulfinic acid.

The combined systems which are composed of at least one organic reducing agent and at least one peroxide and/or hydroperoxide, for example tert-butyl hydroperoxide and the sodium salt of hydroxymethanesulfinic acid or hydrogen peroxide and ascorbic acid, are also suitable. Combined systems which additionally contain a small amount of a metal compound which is soluble in the polymerization medium and whose metallic component may occur in a plurality of valency states, for example ascorbic acid/iron(II) sulfate/hydrogen peroxide, are also useful, the sodium salt of hydroxymethanesulfinic acid, sodium sulfite, sodium bisulfite or sodium metabisulfite also frequently being used instead of ascorbic acid, and tert-butyl hydroperoxide or alkali metal peroxodisulfates and/or ammonium peroxodisulfates are also used. As a rule, the amount of free radical initiator systems used is from 0.1 to 3% by weight, based on the total amount of the monomers to be polymerized. Ammonium and/or alkali metal peroxodisulfates, as such or as part of combined systems, are particularly preferably used as initiators. Sodium peroxodisulfate is particularly preferably used.

The manner in which the free radical initiator system is added to the polymerization vessel in the course of the free radical aqueous emulsion polymerization is known to a person skilled in the art. It may be initially taken in its entirety in the polymerization vessel or added continuously or stepwise at the rate at which it is consumed in the course of free radical aqueous emulsion polymerization. This depends specifically, in a manner known per se to a person skilled in the art, both on the chemical nature of the initiator system and on the polymerization temperature. Preferably, a portion is initially taken and the remainder is added to the polymerization zone at the rate of consumption.

In the case of the emulsion polymerization, known ionic and/or nonionic emulsifiers and/or protective colloids or stabilizers can be used.

Suitable surfactants of this type are in principle the protective colloids and emulsifiers usually used as dispersants. A detailed description of suitable protective colloids appears in Houben-Weyl, Methoden der organischen Chemie, Volume XIV/1, Makromolekulare Stoffe, Georg-Thieme-Verlag, Stuttgart, 1961, pages 411 to 420. Anionic, cationic, and nonionic emulsifiers are suitable as accompanying emulsifiers. Exclusively emulsifiers whose relative molecular weights are usually less than 2000, in contrast to the protective colloids, are preferably used. Anionic and nonionic emulsifiers are preferably used as accompanying surfactants. Conventional accompanying emulsifiers are, for example, ethoxylated fatty alcohols (degree of ethoxylation: from 3 to 50, alkyl radical: C8 to C36), ethoxylated mono-, di- and trialkylphenols (degree of ethoxylation: from 3 to 50, alkyl radical: C4 to C9), alkali metal salts of dialkyl esters of sulfosuccinic acid and alkali metal and ammonium salts of alkylsulfates (alkyl radical: C8 to C12), of ethoxylated alkanols (degree of ethoxylation: from 4 to 30, alkyl radical: C12 to C18), of ethoxylated alkylphenols (degree of ethoxylation: from 3 to 50, alkyl radical: C4 to C9), of alkanesulfonic acids (alkyl radical: C112 to C18) and of alkylarylsulfonic acids (alkyl radical: C9 to C18).

Further suitable emulsifiers are described in Houben-Weyl, Methoden der organischen Chemie, Volume XIV/1, Makromolekulare Stoffe, Georg Thieme Verlag, Stuttgart, 1961, pages 192 to 208.

The emulsions can also be prepared using a protective colloid in addition to an existing emulsifier or in the absence of an emulsifier, and the amount of the protective colloid may be up to 100, preferably from 0.5 to 30, % by weight, based on the amount of the monomers used.

In the process, this protective colloid may be added completely or partially, at the same time as the monomers or at a different time, together with the monomers or separately therefrom; it may be advantageous initially to take up to 30, preferably up to 10, % by weight, based on monomers, of protective colloid in aqueous solution.

Examples of natural protective colloids are starch, casein, gelatine and alginates, and examples of modified natural products are hydroxyethylcellulose, methylcellulose and carboxymethylcellulose, as well as cationically modified starch. Suitable synthetic protective colloids include polyacrylic acid and salts thereof, polyacrylamides, water-soluble acrylic acid copolymers, water-soluble acrylamide copolymers, polyvinylpyrrolidones, polyvinyl alcohols, and partially hydrolyzed polyvinyl alcohols.

It may be advantageous if some of the protective colloid is grafted onto the polymer.

The emulsion polymerization is carried out, as a rule, at from 30 to 95° C., preferably from 75 to 90° C. The polymerization medium may consist of water alone or of a mixture of water and water-miscible liquids, such as methanol. Preferably, water alone is used. The emulsion polymerization may be carried out both as a batchwise process and in the form of a feed process, including the step or gradient procedure. The feed process, in which some of the polymerization batch is initially taken, heated to the polymerization temperature and polymerized and the remainder of the polymerization batch is then added to the polymerization zone, usually via a plurality of spatially separated feeds, one or more of which contain the monomers in pure or emulsified form, continuously, stepwise or with superposition of a concentration gradient, while maintaining the polymerization is preferred.

The free radical aqueous emulsion polymerization can of course also be carried out at superatmospheric or reduced pressure.

The aqueous polymerization emulsions are generally prepared with total solids contents of from 15 to 75, preferably from 40 to 60, % by weight.

The latixes may contain conventional assistants, such as potassium hydroxide, ammonia, or ethanolamine as neutralizing agents, silicone compounds as antifoams, biocides, and silicone oils or waxes for reducing the tack.

The compositions of the present invention may further contain additional additives. The additives can be any additive that may be generally included in a paper coating composition or any additive that may be used to make a specific composition. Further additives include, but are not limited to, surfactants, wetting agents, protective colloids, fillers, coloring agents, antiseptics, biocides, dispersing agents, thickening agents, thixotropic agents, anti-freezing agents, pH adjusting agents, corrosion inhibitors, ultraviolet light stabilizers, crosslinking promoters, and antioxidants.

Examples of surfactants and wetting agents include, but are not limited to, the surfactants listed above, sulfosuccinates, fluorinated surfactants, and silicone surfactants.

Examples of protective colloids are partially and fully hydrolyzed polyvinyl alcohol, hydroxyethyl cellulose, hydroxymethyl cellulose, ethylhydroxyethyl cellulose, carboxymethyl cellulose, ethoxylated starch derivatives, polyacrylic acid, alkali metal polyacrylates, polyacrylamide, poly (methyl vinyl ether/maleic anhydride), polyvinylpyrrolidone, water soluble starch, glue, gelatin, water soluble alginates, guar, gum arabic, and gum tragacanth. The amount of protective colloids used in the composition varies depending upon the intended application and generally ranges from about 0.1 weight percent to about 2 weight percent based on the total weight of the composition.

Examples of fillers include talc, calcium carbonate, diatomaceous earth, mica, kaolin, barium sulfate, magnesium carbonate, Aerosil, vermiculite, graphite, alumina, silica, and rubber powder. Coloring agents such as titanium dioxide and carbon black can also be used as the fillers. The amount of the filler generally ranges from about 5 weight percent to about 50 weight percent based on the total weight of the composition of the present invention.

Various organic pigments and inorganic pigments may be broadly used as the coloring agents, but non-toxic anticorrosive pigments are preferred. Examples of such pigments are phosphate-type anticorrosive pigments such as zinc phosphate, calcium phosphate, aluminum phosphate, titanium phosphate, silicon phosphate, and ortho-and fused phosphates of these;

molybdate-type anticorrosive pigments such as zinc molybdate, calcium molybdate, calcium zinc molybdate, potassium zinc molybdate, potassium zinc phosphomolybdate and potassium calcium phosphomolybdate; and borate-type anticorrosive pigments such as calcium borate, zinc borate, barium borate, barium meta-borate and calcium meta-borate. Also, any color pigment, effect pigment, or color and effect pigment may be used. The amount of the coloring agent used may also be properly selected based on the end-use application of the compositions of the present invention.

Examples of the antiseptics are pyrrole compounds, imidazole compounds, thiazole compounds, pyridine compounds and organic halogen compounds. The amount of the antiseptic can be suitably selected, and is, for example, up to about 4 percent by weight based on the total weight (as solids content) of the composition.

Examples of the biocides, which are used either as wet-state protectors or as film protectors of a coating composition, are a wide variety of bactericides, fungicides or algicides, and include, but are not limited to, zinc oxide, cuprous oxide, organotin pigments, copolymers of organotin esters of methacrylic acid with acrylates, tributyl tin oxide, and mixtures thereof. Other examples of biocides particularly useful as wet-state protectors are oxazoladines, organosulfurs, and benzisothiazolins. Any general toxic agent may be suitable as a biocide.

The dispersing agents include, but are not limited to, inorganic dispersing agents such as sodium salts of polycarboxylic acids, sodium or ammonium salts of fused naphthalene sulfonate, polyoxyalkylene alkyl ethers of phenol ether, sorbitan fatty acid esters, polyoxyalkylene fatty acid esters, glycerin fatty acid esters, polyoxyethylene styrene phenol, sodium tripolyphosphate and sodium hexametaphosphate. As described above, organosilanol derivatives of tung oil, or linseed oil, or high erucic acid rapeseed oil that are useful as surfactants are also suitable as dispersing agents. The amount of the dispersing agent generally ranges up to about 10 weight percent based on the total weight of the composition.

The thickening and thixotropic agents may be one and the same or different and may be the same as the protective colloids referred to above. Examples of thickening or thixotropic agents are polyvinyl alcohol, cellulose derivatives such as hydroxyethyl cellulose, hydroxypropyl cellulose and carboxymethyl cellulose salt, polyether compounds, urethane modified polyether compounds, polycarboxylic acid compounds, sodium salts of polycarboxylic compounds, polyvinylpyrrolidone, polyoxyethylene derivatives such as polyethylene glycol ether and polyethylene glycol distearate, sodium alginate and inorganic materials such as sodium silicate and bentonite. The amounts of the thickening or the thixotropic agents can be properly chosen depending upon the type of end-application of the composition of the present invention.

Examples of the pH adjusting agents include, but are not limited to, sodium hydroxide, potassium hydroxide, sodium hydrogen carbonate, ammonium hydroxide, ammonia, amines, triethanolamine, and 3-dimethylaminoethanol. The amount of the pH adjusting agent is selected such that the composition has a desired pH.

Examples of the crosslinking promoters include, but are not limited to, carbodiimides.

The composition can be a paper coating slip, preferably in the form of an aqueous emulsion.

The aqueous emulsions of these binder mixtures have solids contents of from 15 to 65, preferably from 40 to 60, % by weight. The emulsions are preferably prepared by mixing the emulsions of the individual components with stirring at room temperature.

As a paper coating slip, the composition preferably contains the blend of the vinyl aromatic-acrylic polymer and the vinyl aromatic-diene polymer in amounts of from 1 to 50, preferably from 5 to 20, % by weight, based on the pigment content of the paper coating slip.

Pigments are usually the main component of a paper coating slip. Frequently used pigments include, but are not limited to, barium sulfate, calcium carbonate, calcium sulfoaluminate, kaolin, talc, titanium dioxide, zinc oxide, chalk, or coating clay.

The paper coating slip may also contain conventional dispersants. Suitable dispersants are polyanions, for example of polyphosphoric acids, or salts of polyacrylic acids (polysalts), which are usually present in amounts of from 0.1 to 3% by weight, based on the amount of pigment.

The paper coating slip may furthermore contain cobinders. Examples of naturally occurring cobinders are starch, casein, gelatine, and alginates, and examples of modified naturally occurring products are hydroxyethylcellulose, methylcellulose, carboxymethylcellulose, and cationically modified starch. Additionally, synthetic cobinders, eg those based on vinyl acetate or on acrylate, may also be used.

These may be present in amounts of from 0.1 to 10% by weight, based on the amount of pigment.

The paper coating slip can be applied by the conventional method to the papers to be coated (cf. Ullmann's Encyklopadie der Technischen Chemie, 4th Edition, Vol. 17, page 603 et seq.).

The paper substrate that is coated with the composition can be any paper substrate including, but not limited to paper and paper board.

The method of the present invention can be used with any type of paper coating process including, but not limited to, rotogravure, sheet offset, web offset, and flexographic.

The papers coated in this manner have good uniform printability, ie. very little tendency to mottling, in the subsequent printing process by the offset printing method, ie. in contact with the printing ink/water system.

Making a paper/paperboard coating using the composition of the present invention can improve the properties of the paper coating. Properties that can be improved include coater and machine runnability, sheet gloss, glueability, pick resistance, and printability properties (mottle resistance, print gloss, printed smoothness, varnish gloss, ink holdout, dot gain) for web and sheet offset printing (lithographic printing). As for rotogravure and flexographic printing, missing dots, PPS, smoothness, Helio halftone, print gloss COF and whiskering are properties tested and found to be improved with this invention.

SPECIFIC EMBODIMENTS OF THE INVENTION

The invention is further described in the following examples. The examples are merely illustrative and do not in any way limit the scope of the invention as described and claimed. The test methods used are described below.

EXAMPLE 1

The following coating composition for rotogravure printing was prepared by mixing the listed ingredients (the amounts are parts by dry weight): 50 parts delaminated clay, 40 parts talc, 10 parts calcined clay, 5 parts latex, 1.2 parts calcium stearate, and thickener (STEROCOLL™ FD from BASF) until the mixture had a viscosity of 500 to 800 cps at 100 rpm on a Brookfield RVT viscometer. The pH of the mixture was about 8.7, and the total solids was about 52–54%. The latex in the composition was one of four latexes, which were a styrene-butadiene polymer (diamond); a styrene-butadiene polymer (circle); styrene-acrylic (square); and a mixture of a styrene-butadiene and a styrene-acrylic, 55% by weight styrene-acrylic (triangle).

The four compositions were coated on paper at $6g/m^2$. The paper was tested for Helio Variable Halftone and Parker Print Surf. The results of Helio Variable Halftone was plotted against Parker Print Surf (pps), and the results are shown in FIG. 1. The vinyl aromatic-acrylic and vinyl aromatic-diene blend is shown by the triangle, the styrene acrylic is shown by the square, the styrene-butadiene is shown by the circle, and the other styrene-butadiene is shown by the diamond.

Figure 2:
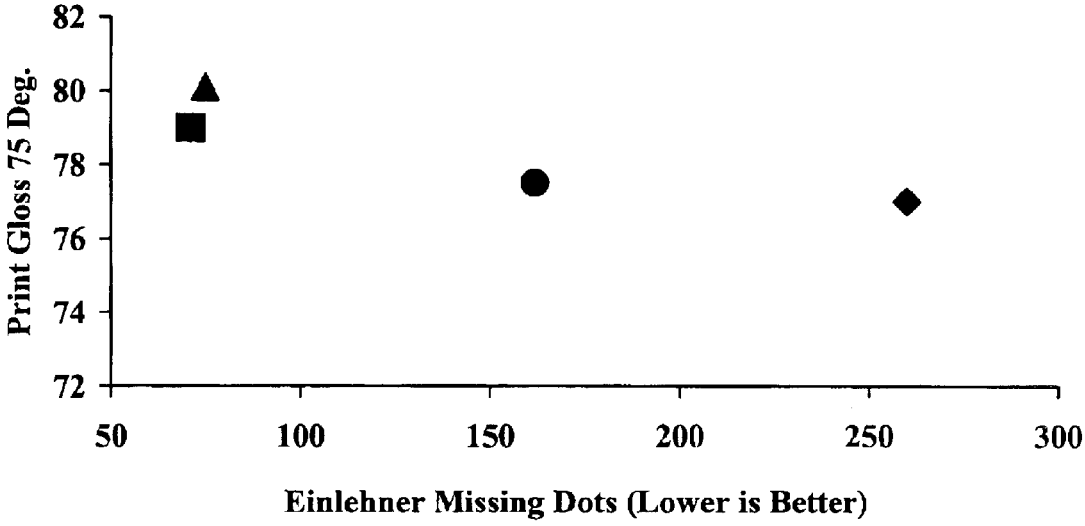
FIG. 2 is a graph of Print Gloss at 75° vs. Einlehner Missing Dots for the samples from Example 1.

Also, the paper was tested for print gloss at 75° and Einlehner Missing Dots. The results of print gloss was plotted against Einlehner Missing Dots, and the results are shown in FIG. 2. The vinyl aromatic-acrylic and vinyl aromatic-diene blend is shown by the triangle, the styrene acrylic is shown by the square, the styrene-butadiene is shown by the circle, and the other styrene-butadiene is shown by the diamond.

EXAMPLE 2

The following coating composition for free sheet web offset printing was prepared by mixing the listed ingredients (the amounts are parts by dry weight): 40 parts No. 1 clay, 50 parts fine calcium carbonate, 5 parts titanium dioxide, 5 parts plastic pigment, 12.5 parts latex, 3 parts starch, 0.6 parts crosslinker (CURESAN™ 199 glyoxal insolubilizer from BASF), and 0.1 parts thickener (STEROCOLL™ FD from BASF). The pH of the mixture was about 8.5, and the total solids was about 64%. The latex in the composition were the latexes from Example 1.

Figure 3:
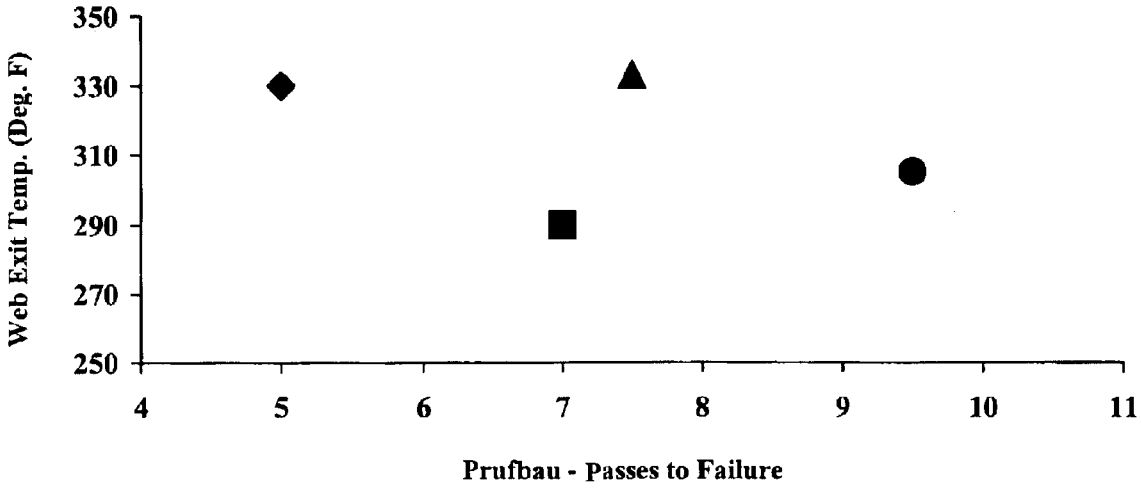
FIG. 3 is a graph of Commercial Blister Resistance vs. Pick Strength (Prufbau) for the samples from Example 2.

The four compositions were coated on paper at 6g/m$^2$. The paper was tested for Commercial Blister Resistance and Pick Strength. The results of Commercial Blister Resistance was plotted against Pick Strength (Prufbau), and the results are shown in FIG. 3. The vinyl aromatic-acrylic and vinyl aromatic-diene blend is shown by the triangle, the styrene acrylic is shown by the square, the styrene-butadiene is shown by the circle, and the other styrene-butadiene is shown by the diamond. The results show that the paper was able to reach superior strength and excellent blister resistance at the same time. Under normal conditions, blister resistance comes while sacrificing strength.

Print Surf was conducted according to TAPPI T-555.

Helio Variable Halftone Test

Heliotest print is a procedure that is used to simulate the rotogravure printing process. A paper test strip is dynamically printed at a given speed and pressure by means of an engraved printing disk from which excess ink has been previously scraped off. The apparatus consists of a printing disk on which are engraved patterns, designed and dimensioned, according to the results of the criteria for the industrial classing of paper printability. Three engraved areas are combined onto one roll, a conventional halftone area; a variable halftone screen; and lines of dots.

1. Procedure 1.1. Apparatus 1.1.1. IGT (AIC2–5) Printability Tester 1.1.2. IGT Rubber Blanket or Appropriate Backing Material 1.1.3. Doctor Blade Assembly 1.1.4. Heliotest Printing Disk 1.1.5. Heliotest Ink 1.1.6. Paper strips to be tested at least 5.08 cm (2") to 6.35 cm (2.5") wide and sufficient length to cover printed area (Machine Direction) approximately 33 cm (13").

1.2. General 1.2.1. Allow strips of paper to equilibrate in a temperature and humidity controlled room of approximately 21.1° C. ±1.7° C. (70° F. ±3° F.) and 50% relative humidity ±4% for 24 hours.

1.2.2. A minimum of 5 strips of the size as stated in 1.1.6 are to be tested for each coated sample.

1.3. Set Up 1.3.1. Remove all packing strips from the cylinder.

1.3.2. Place the support holder plate in the fixing hole found in the upper left hand corner.

1.3.3. Define the wiping up angle with the template by locking the cylinder into place. Place the template on the axis of the support holder plate. Place the template in contact with the bare cylinder. Tighten the support holder plate in this position with the hexagonal aperture bolt.

1.3.4. Remove the template and insert one rubber blanket onto the cylinder. Make certain the blanket is as tight as possible.

1.3.5. Insert the doctor blade between the blade support and blade holder. Install the blade assembly with counterweight onto the support-holder axis. Make sure the notched side of the blade is on the right side of the disk when it comes into contact with the disk.

Adjustments 1.3.6. Insert a test strip onto the rubber blanket, keeping it as tight as possible. Rotate the cylinder counter clockwise until it locks into place.

1.3.7. Install the Helio Printing disk onto the top spindle of the tester.

1.3.8. Bring the disk into contact with the test strip by turning the handle on the top left hand side of the tester, counter clockwise until it stops.

1.3.9. Adjust the pressure to 45 kgf with the handle on the bottom right side.

1.3.10. Set the speed slide lever switch to constant speed. Set the speed to Im/s.

1.4. Procedure for Printing 1.4.1. Place sample to be tested onto the rubber, keeping it as tight as possible. Lock cylinder into place.

1.4.2. Install the Helio Printing disc onto the top spindle of the tester.

1.4.3. Gently swing over the counterweight and, delicately place the doctor blade in contact with the printing disk.

1.4.4. Deposit 4–5 drops of the Helio test ink in the wedge formed by the printing disk and the doctor blade.

1.4.5. Rotate the printing disk only clockwise, for ten revolutions in order to spread out the ink and fill all the engraved cells.

1.4.6. Adjust the counterweight, only if necessary, to obtain correct wiping up of the printing disk. Only the engraved cells should appear tinted against the shine of the chrome.

1.4.7. After several revolutions, stop the printing disk at the appropriate position in order to print the variable halftone block.

1.4.8. Turn the top left-hand knob to the "on" position. This brings the disk into contact with the test strip. Speed, pressure and backlash should still be set.

1.4.9. Press and hold motor button in, when speed levels out, press and hold in the clutch button.

1.4.10. Release the print disk from the test strip.

2. Reporting of Test Results 2.1. The use of a magnifying glass for observation is recommended.

2.1.1. Lines and Dots: Count the total number of missing dots in the four lines of dots.

2.1.2. Variable Halftone Screen: The distance is measured in (mm) on the samples, starting at the end with the heavy tone, between the start of the impression and the 20th missing dot.

2.1.3. Report the average of the 5 (minimum # of replicates) readings as # of missing dots/length in mm.

Prufbau Pick Strength

The fountain in the Prufbau instrument allows a defined amount of solution to be applied at a constant speed to the test sample. The test sample then passes through a print station at an accelerated speed and pick of the coating shows in the wetted area. The density of ink in the wet area versus the dry area is measured and the difference is reported as Percent (%) Retention.

1. Procedure 1.1. Apparatus/Reagent Requirements 1.1.1. Multipurpose print test machine (Prufbau with wetting unit attached)

1.1.2. Ink—A Standard Process ink (12 Tack is the standard ink used in routine work.).

1.1.3. Printing Form —4 cm wide blanket disc 1.1.4. Printing Pressure —600 N 1.1.5. Printing Speed —3 m/s constant 1.1.6. Wetting Unit Speed —1 m/s constant 1.1.7. Inking Unit Requirements —0.16 mL Release fountain solution at the same time on each sample for the entire series of samples. (50 to 54 seconds range).

1.1.8. Fountain Solution —10 μL of 90/10 blend of water and isopropyl alcohol.

1.1.9. Wetting Unit delay timer adjusted to achieve pick. (Start at 1 second, then adjust delay on control sample as needed to see pick.

1.2. Procedure Steps 1.2.1. Allow strips of paper to equilibrate in a temperature and humidity controlled room of approximately 21.1C+1.7C.(70° F. ±3° F.) and 50% relative humidity +4% for 24 hours.

1.2.2. Cut samples to measure approximately 240 mm ±2 mm by 47 ±0.5 mm. If the sample is too wide, it may interfere with the run through the apparatus. If the sample is too narrow, it may result in the sample running off sideways, or askew.

1.2.3. Place the sample under clip located at the end of the sample carrier and fold sample back 180° so that it lies flat and parallel on the carrier with the side to be tested uppermost. Secure the free end with tape. Do not allow finger prints to contaminate the portion of the sample to be tested.

1.2.4. Turn-power and cooling unit on. Place ink distribution roll in contact with the drive rolls. Turn distributor rolls on and allow to run for at least 15 minutes prior to testing to allow temperature control balance.

1.2.5. Place carrier, with the sample attached, in carrier slot in front of the wetting unit.

1.2.6. Fill wetting unit pipette to 10 μl with fountain solution and place in the wetting unit.

1.2.7. Stop ink distribution rollers and apply 0.16 ml (1.6 turns on ink pipette) ink to the roller station.

1.2.8. Start the ink distribution rollers and timer simultaneously.

1.2.9. At 30 seconds elapsed time, place the blanketed print disc in contact with the ink roller.

1.2.10. Release fountain solution at the same time on each sample in the series (50 to 54 seconds range). Start the fountain rollers at the release of solution.

1.2.11. At 60 seconds elapsed time, remove print disc from ink roll and mount on the printing unit core. Start the core motor.

1.2.12. At the time of the fountain alarm, lift the lever on the fountain. This will send the carrier through the wetting and printing stations.

1.2.13. Remove the test strip from the carrier and allow the ink to dry before reading the ink density.

1.2.14. Stop the core drive motor and the fountain unit.

1.2.15. Repeat steps 1.2.5 through 1.2.14 for each sample to be tested.

1.2.16. With the aid of densitometer, read ink density in 10 dry areas and in 10 wet areas of each strip. Report average density in the dry area. Report average density in the wet area Report % retention of ink ((Wet Average/Dry Average)×100).

Commercial Blister Resistance is tested by raising the temperature in an oven until blistering of the paper is observed.

Print Gloss

1. Procedure 1.1. Apparatus/Reagent Requirements 1.1.1. Prufbau Printability Tester, including ink distribution rollers 1.1.2. Prufbau rubber covered print form 1.1.3. IGT Ink pipette with vernier scale 1.1.4. Ink; A Standard Gloss Study Magenta ink 1.1.5. Ink Densitometer (X-Rite model 418 or equivalent)

1.1.6. Paper samples to be tested (approximately 45 nm by 240 mm)

1.1.7. Prufbau sample carrier (322 mm in length).

1.2. Procedure Steps 1.2.1. Turn on Prufbau Printability Tester. Set impression pressure on gauge to 200 Newtons and printing speed at 0.5 m/s. Turn on cooling water supply.

1.2.2. Fill the IGT ink pipette.

1.2.3. Place sample in carrier.

1.2.4. Apply ink (approximately 0.2 ml is a good starting point) to the ink distribution system and turn system on.

1.2.5. After allowing ink to distribute for 30 seconds, bring blanketed print form into contact with ink distribution rollers.

1.2.6. After inking up for 30 seconds, remove print form from inking rollers and place on hub of printing station. Adjusting print form so that the blanket split is on top will help to decrease interference of non-printed area when taking readings.

1.2.7. Place loaded sample carrier on printing track, adjacent to printing station.

1.2.8. Actuate print station motor to print sample.

1.2.9. Remove sample from carrier and take one density reading using X-Rite densitometer. All samples should have density readings within ±0.05 of the density target. If density meets requirements, set sample aside to cure overnight.

1.2.10. Apply ink to next distribution station and repeat process for all samples. After four sample strips, clean ink train and print forms.

After curing, measure printed area gloss. Take five measurements per strip per test and average the results for each condition.

After curing, measure printed area ink density. Take five measurements per strip per test and average the results for each condition.

It should be appreciated that the present invention is not limited to the specific embodiments described above, but includes variations, modifications and equivalent embodiments defined by the following claims.

What is claimed is:

1. A method comprising:

(I) providing a composition;

(II) applying the composition to a paper substrate; and (III) forming a paper coating on the paper substrate;

wherein the composition comprises a blend of polymers, wherein the blend of polymers comprises a vinyl aromatic-acrylic polymer and a vinyl aromatic-diene polymer, wherein the vinyl aromatic-acrylic polymer comprises a reaction product of a vinyl aromatic and an alkyl (meth) acrylate, and the vinyl aromatic-diene polymer comprises a reaction product of a vinyl aromatic and a conjugated diene, wherein, based on a solids weight of all polymers in the blend of polymers, the vinyl aromatic-acrylic polymer is present in the blend of polymers in an amount from 50% to about 95% and the vinyl aromatic-diene polymer is present in an amount from about 5% to 50%, wherein when the vinyl aromatic-acrylic polymer is present in the blend of polymers in an amount from 50% to 65%, the amount of vinyl aromatic in the vinyl aromatic-acrylic polymer is from about 5% to less than 20% by weight.

2. The method of claim 1, wherein, based on the total weight of the vinyl aromatic-diene polymer, the vinyl aromatic is present in an amount from about 40% to about 85%, and the conjugated diene is present in an amount from about 15% to about 60%.

3. The method of claim 1, wherein based on the total weight of the vinyl aromatic-alkyl (meth)acrylate polymer, the vinyl aromatic is present in an amount from about 5% to about 60%, and the alkyl (meth)acrylate is present in an amount from about 40% to about 95%.

4. The method of claim 1, wherein the alkyl (meth) acrylate is a $C_1$–$C_2$ (meth) acrylate.

5. The method of claim 1, wherein the alkyl(meth)acrylate is a $C_4$–$C_{12}$ (meth)acrylate.

6. The method of claim 1, wherein the vinyl aromatic-acrylic polymer comprises a reaction product of the vinyl aromatic, the alkyl (meth)acrylate, and at least one of an ethylenically unsaturated carboxylic acid and (meth) acrylonitrile.

7. The method of claim 1, wherein the vinyl aromatic-acrylic polymer consists of a reaction product of the vinyl aromatic, the alkyl (meth) acrylate, and at least one monomer selected from the group consisting of an ethylenically unsaturated carboxylic acid, (meth)acrylonitrile, and combinations thereof.

8. The method of claim 1, wherein the vinyl aromatic-acrylic polymer is at least one of a n-butyl acrylate-styrene polymer and a n-butyl acrylate-styrene-acrylonitrile polymer.

9. The method of claim 1, wherein the vinyl aromatic-diene polymer comprises a reaction product of the vinyl aromatic, the conjugated diene, and at least one of an ethylenically unsaturated carboxylic acid and (meth) acrylonitrile.

10. The method of claim 1, wherein the vinyl aromatic-diene polymer consists of a reaction product of the vinyl aromatic, the conjugated diene, and at least one monomer selected from the group consisting of an ethylenically unsaturated carboxylic acid, (meth)acrylonitrile, and combinations thereof.

11. The method of claim 1, wherein the vinyl aromatic-diene polymer is at least one of a styrene-butadiene polymer, a styrene-butadiene-acrylonitrile polymer, and a carboxylated styrene-butadiene polymer.

12. The method of claim 1, wherein the composition further comprises at least one of a surfactant, a wetting agent, a protective colloid, a filler, a coloring agent, an antiseptic, a biocide, a dispersing agent, a thickening agent, a thixotropic agent, an antifreezing agent, a pH adjusting agent, a corrosion inhibitor, an ultraviolet light stabilizer, a crosslinking promoter, and an antioxidants.

13. The method of claim 1, wherein the blend of polymers consists of the vinyl aromatic-acrylic polymer and the vinyl aromatic-diene polymer.

* * * * *